US007405522B2

(12) United States Patent
Stack

(10) Patent No.: US 7,405,522 B2
(45) Date of Patent: Jul. 29, 2008

(54) MULTIPLE FAILURE DETECTION SHUTDOWN PROTECTION CIRCUIT FOR AN ELECTRONIC BALLAST

(75) Inventor: Thomas Stack, Utica, MI (US)

(73) Assignee: Q Technology, Inc., Livermore, CA (US)

( * ) Notice: Subject to any disclaimer, the term of this patent is extended or adjusted under 35 U.S.C. 154(b) by 0 days.

(21) Appl. No.: 10/649,885

(22) Filed: Aug. 26, 2003

(65) Prior Publication Data

US 2005/0046357 A1 Mar. 3, 2005

(51) Int. Cl.
*H05B 37/00* (2006.01)

(52) U.S. Cl. ..... 315/127; 315/209 R; 315/291; 315/360; 315/224; 315/DIG. 4; 315/DIG. 7

(58) Field of Classification Search ..... 315/119, 315/127, 225, 224, 307, 291, 209 R, DIG. 4, 315/DIG. 5, DIG. 7, 125, 276, 244, 246, 315/308, 210, 360; 363/34, 37, 53, 56
See application file for complete search history.

(56) References Cited

U.S. PATENT DOCUMENTS

| | | | | | |
|---|---|---|---|---|---|
| 3,699,382 | A | | 10/1972 | Franke | 315/92 |
| 4,382,212 | A | * | 5/1983 | Bay | 315/225 |
| 4,523,131 | A | * | 6/1985 | Zansky | 315/307 |
| 4,535,399 | A | * | 8/1985 | Szepesi | 363/41 |
| 4,554,487 | A | | 11/1985 | Nilssen | 315/224 |
| 4,667,131 | A | | 5/1987 | Nilssen | 315/275 |
| 5,451,845 | A | | 9/1995 | Ribarich | 315/225 |
| 5,475,284 | A | | 12/1995 | Lester et al. | 315/209 R |
| 5,574,335 | A | * | 11/1996 | Sun | 315/119 |
| 5,619,105 | A | * | 4/1997 | Holmquest | 315/225 |
| 5,636,111 | A | * | 6/1997 | Griffin et al. | 363/37 |
| 5,650,694 | A | * | 7/1997 | Jayaraman et al. | 315/225 |
| 5,789,870 | A | | 8/1998 | Remson | 315/194 |
| 5,834,903 | A | * | 11/1998 | Christian | 315/219 |
| 5,889,370 | A | | 3/1999 | Arai et al. | 315/85 |
| 5,930,126 | A | | 7/1999 | Griffin et al. | 363/37 |
| 6,008,592 | A | | 12/1999 | Ribarich | 315/225 |
| 6,198,226 | B1 | | 3/2001 | Koskuba, Jr. | 315/169.3 |

(Continued)

*Primary Examiner*—Haissa Philogene
(74) *Attorney, Agent, or Firm*—Theodore C. Huff

(57) ABSTRACT

A shut-down circuit configured for use with an electronic ballast coupled to a lamp in a control path includes a device for sensing the electrical energy associated with the control path, and a sensing circuit for shutting down the ballast in the event that the energy does not conform to a predetermined condition. The sensed energy may be current indicative of lamp installation or removal, or voltage indicative of arcing. The device for sensing the electrical energy associated with the control path may be an isolation transformer or alternative devices such as optical isolators may be employed. The circuitry may further include electronic componentry to disable the sensing circuit during initial energization of the lamp. In one disclosed example, the sensing circuit includes a node that should be at or near a predetermined electrical potential when the lamp is operating properly, and a switch such as a Schmitt trigger coupled to the node that turns on or off to shut down the ballast if the node is not at or near the predetermined electrical potential. In an implementation used to detect voltage fluctuations indicative of arcing, the circuitry may include a high-pass filter or differentiator and detector to detect high-frequency noise. Alternatively, a phase-locked loop may be coupled to a low-pass filter to detect high-frequency noise indicative of arcing.

2 Claims, 5 Drawing Sheets

U.S. PATENT DOCUMENTS

| | | | | |
|---|---|---|---|---|
| 6,222,322 | B1 | 4/2001 | Stack | 315/119 |
| 6,292,339 | B1 * | 9/2001 | Brooks | 361/78 |
| 6,331,755 | B1 | 12/2001 | Ribarich et al. | 315/225 |
| 6,420,838 | B1 | 7/2002 | Shackle | 315/224 |
| 6,504,318 | B1 | 1/2003 | Pienisaari | 315/242 |
| 6,541,923 | B1 | 4/2003 | Tyson | |
| 6,781,326 | B2 * | 8/2004 | Stack | 315/291 |
| 6,809,483 | B2 * | 10/2004 | Alexandrov | 315/224 |
| 2002/0113559 | A1 * | 8/2002 | Lam | 315/224 |
| 2002/0114114 | A1 | 8/2002 | Schmitt | 361/18 |

* cited by examiner (Arcing creates high di/dt signals)

(Optically isolated)

MULTIPLE FAILURE DETECTION SHUTDOWN PROTECTION CIRCUIT FOR AN ELECTRONIC BALLAST

FIELD OF THE INVENTION

This invention relates generally to an electronic ballast and, in particular, to lamp-unseating and arc-detecting shut-down circuit and related improvements.

BACKGROUND OF THE INVENTION

Existing ballast circuits of the type used with fluorescent and, in some cases, neon lamps suffer from certain technical problems. Particularly with respect to single-pin lamps in DC-powered mobile applications, a single interconnection carries both DC input current and AC output current. This causes AC noise and ripple to feed back into the DC power buss distribution system, which, in turn, can affect performance and operation of other systems connected to the DC buss.

FIG. 1 is a diagram of an existing single-pin lamp system. A 24-volt DC supply is connected to a ballast 102 and one side of the lamp 110. Typical of such systems, a safety switch 112 is provided to remove the DC power from the ballast if the lamp is removed. The connections are on either side of the pin, such that when the lamp is removed, the circuit is broken. The other pin 114 of the lamp 110 is connected to the ballast through line 116.

The configuration just described establishes two current paths, including a first current path 120 which includes noisy and high-frequency lamp current, and a second DC ballast input current path 122 which should not include any noise. However, due to the use of the safety switch 112, a single line 130 is common to both the lamp current and DC input current paths. As a result, noise or ripple may be coupled into the DC path, causing AC noise to infiltrate the DC power bus distribution system, leading to performance degradation and failure of other equipment powered by the DC buss, in some cases.

Given that it is not technically straightforward to filter out the conducted electromagnetic interference (EMI) prevalent in existing designs, the need remains for an improved filtering and control circuit configuration.

SUMMARY OF THE INVENTION

This invention resides in a shut-down circuit configured for use with an electronic ballast coupled to a lamp in a control path. In broad and general terms, the circuit includes a device for sensing the electrical energy associated with the control path, and a sensing circuit for shutting down the ballast in the event that the energy does not conform to a predetermined condition. The sensed energy may be current indicative of lamp installation or removal, or voltage indicative of arcing.

In the preferred embodiment, the device for sensing the electrical energy associated with the control path is an isolation transformer; however, in other embodiments alternative devices such as optical isolators may be employed. The circuitry may further include electronic componentry to disable the sensing circuit during initial energization of the lamp.

In one disclosed example, the sensing circuit includes a node that should be at or near a predetermined electrical potential when the lamp is operating properly, and a switch such as a Schmitt trigger coupled to the node that turns on or off to shut down the ballast if the node is not at or near the predetermined electrical potential.

In an implementation used to detect voltage fluctuations indicative of arcing, the circuitry may include a high-pass filter or differentiator and detector to detect high-frequency noise. Alternatively, a phase-locked loop may be coupled to a low-pass filter to detect high-frequency noise indicative of arcing.

DETAILED DESCRIPTION OF THE INVENTION

The system of this invention broadly prevents ripple and ballast-generated noise from feeding back into the buss power system of a lamp control circuit. This is broadly carried out by eliminating the common DC path and lamp current hook-up connection to the lamp. This is more particularly carried out by eliminating the safety switching action of the pin and the socket currently typical of single-pin systems.

According to the invention, ballast shut down is performed electronically when the lamp is removed. The circuit of the invention detects the presence of the lamp current to keep the ballast running, but if the lamp is removed, the ballast shuts down to address safety issues. The invention further includes apparatus and methods to detect arcing that occur if a wire becomes loose, or if the socket is defective. In the preferred embodiment, the circuit detects arcing that lasts longer than a predetermined amount, such as 500 milliseconds, or thereabouts, and shuts down the ballast if such arcing is detected. Broadly, because the output of the ballast is entirely isolated from the DC input, filtering inside the ballast can now attenuate the noise produced by the ballast to acceptable levels.

Figure 2:
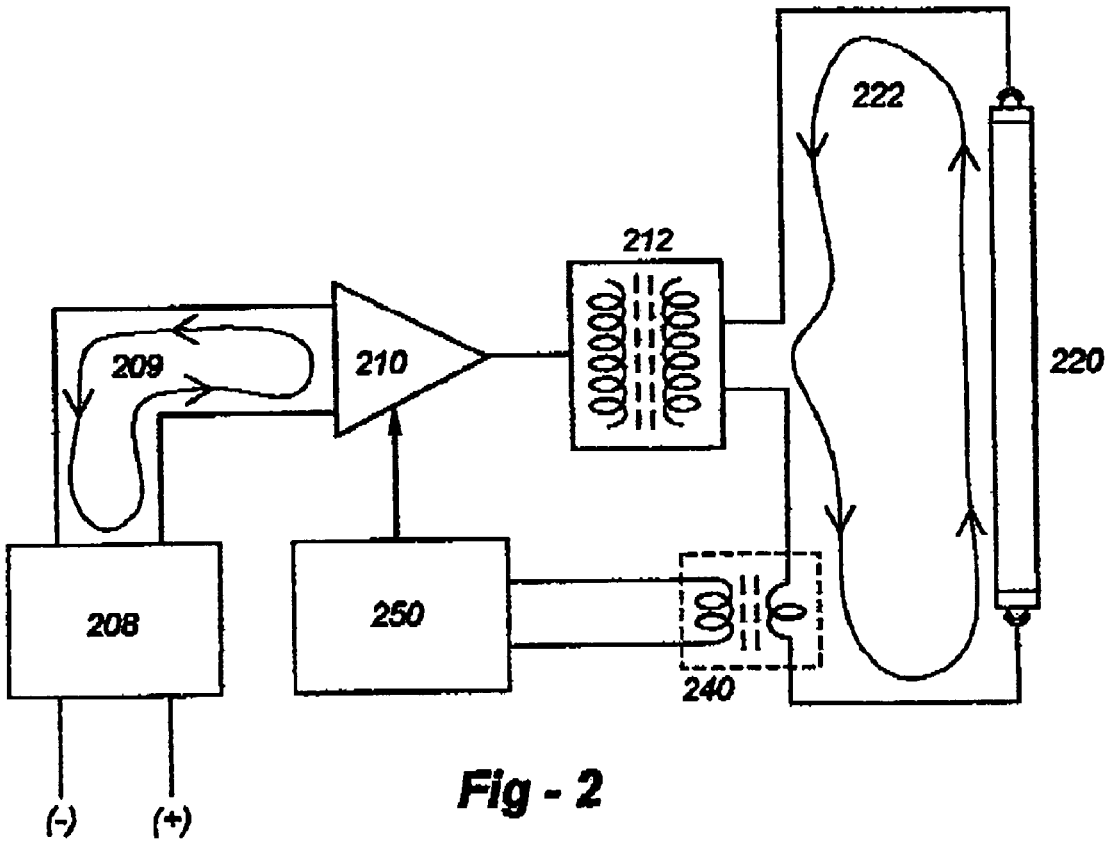
FIG. 2 is a simplified block diagram illustrating important components associated with a preferred embodiment of this invention.

Reference is now made to FIG. 2, which depicts in block-diagram form a circuit configuration according to the invention. Twenty-four volts DC is provided to a ballast inverter 210, preferably through a line filter 208. The output of the ballast inverter 210 is fed to an isolation output transformer 212, which forms a lamp current path 222 to operate lamp. This configuration allows relatively little noise to couple back into the DC line, because the inverter ripple and noise current 209 are separate from the lamp current path 222.

Figure 1:
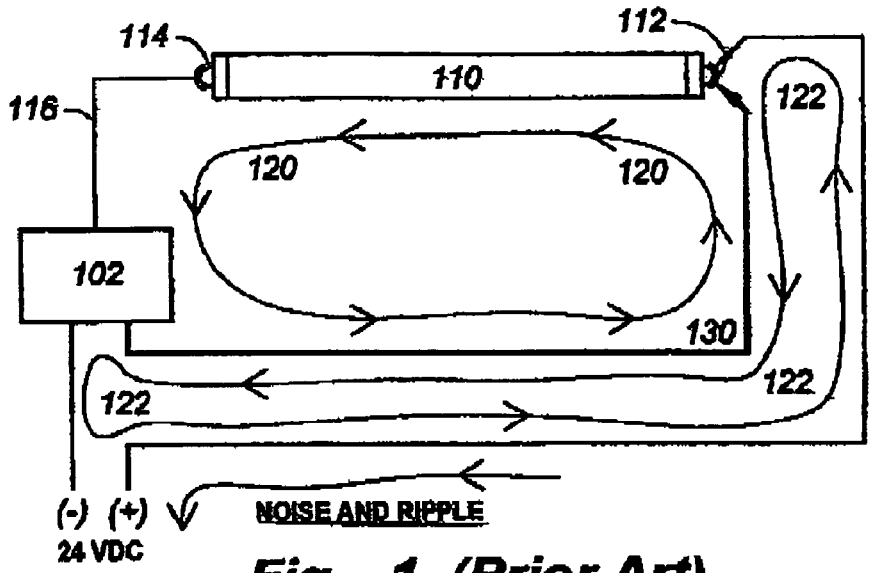
Fig – 1 (Prior Art)
FIG. 1 is a schematic diagram illustrating the problem associated with existing ballast circuits wherein an electrical path is common to both the DC and AC circuits.

The use of a ballast inverter coupled to an isolation output transformer in a fluorescent lamp control circuit is well known, but previously limited to the mechanical type of system shutoff described with respect to FIG. 1. Novel to this invention, is the use of an arc detection feature and a lamp current/arc sensing circuit 250 to control the ballast inverter 210. In the preferred embodiment, isolation output transformer 240 is used to cover a portion of the lamp current to the sensing circuit 250. However, as will be described in further detail below, different types of arc detection may be utilized in accordance with this invention.

Given the simplified block diagram of FIG. 2, the reader's attention is now directed to FIG. 3, which shows an actual schematic for a circuit constructed in accordance with this invention. In this diagram, T1 is the isolation current transformer, T2 is a step-up transformer and L2 is a line filter. The DC input voltage (24 Vdc) gets connected at the plus and minus terminals shown at the bottom of the drawing.

Q1 and Q2 function as inverters. Although they are preferably implemented utilizing MOSFETs, they may be bi-polar transistors or other types of switching devices, as appropriate. Inverters Q1 and Q2 are connected in push/pull fashion to the primary winding of transformer T1, that is, the lower windings shown in the diagram have a center tap. L1 is connected to the center tap and to a circuit breaker shown lower in the diagram.

The feedback signal is connected to the upper windings of T1 through R1 and R2. An initial turn-on bias is provided by the center tap winding of T1 through R4. This is known in the art as a Royer-type oscillator. Once oscillation commences, a circuit comprises D5, C1 and R3 serves to clamp the voltage and reduces the turn-on bias coupled to Q1 and Q2 once oscillation begins. Oscillation may be terminated by turning on Q3, a PNP device which pulls down the voltage at the emitter and shuts off the oscillator circuit when asserted. Q4 and Q5 represent a Schmitt trigger used to turn off Q3 very rapidly, causing it to function as a switch as opposed to a linear amplifier. If operated in a linear region of the load line, the device could become overheated.

A point "X" has been labeled in the diagram. When the voltage at this point rises to a level of approximately a volt or more, a Schmitt trigger turns on which causes Q3 to rapidly turn off. This is intentional, since when power is initialized to the ballast, it is desirable to have a lamp come on as soon as possible. During this time, however, the control capability of the circuit must be temporarily disabled or overwritten to allow the lamp to fire. This is accomplished through the use of capacitor C9. On initialization, or first turn on, DC is applied through the filter, through the circuit breaker device, and through the diode D10 which isolates that portion of the circuit which is sensitive to noise. In particular, this isolates the Schmitt trigger and Q3, which is filtered by C10.

In other words, the capacitor C9 upon initialization, causes the rise in voltage approaching 24 volts to energize point "X," which then triggers the Schmitt trigger immediately, allowing the ballast to come on. The capacitor is then discharged through the resistor, and the base-emitter junction of Q5. The disabling of the initial start-up is determined by a time constant set by C9 and R8 when the voltage at the base-emitter junction of Q5 drops to a sufficiently low value, allowing the circuit to be disabled for a portion of a second so that the lamp has the opportunity to energize. A low voltage at point "X" causes Q5 to turn off, which causes Q4 and Q3 to turn on, which causes the inverter to shut down.

Once the capacitor C9 is discharged through the resistor series, thereby disabling the arc detection circuit, the system becomes active to detect current flow through the lamp. T2 serves this function as well, by providing a stepped-up AC voltage which is peak limited by Zener diodes D17 and D18 to prevent damage to the MOSFETs used. Conveniently, the internal parasitic diode of the MOSFET is utilized as a rectifying device, with one end being connected to ground. Whereas the diode normally goes from source to drain with the cathode being connected to the drain, in this case the diode is "pointing up" at the diagram, thereby serving as a rectifying device for the DC voltage generated at the bottom of T2.

R16 provides a current-limiting function when the capacitor is charged so that the voltage across the junction does not become excessive. However, if there were no running voltage through R9, C9 would simply discharge and the system would cycle through shut-off.

Now, if the system is operating properly, and there is a load present, the running voltage will be present at the point X, approximately 3 volts. This value could vary in accordance with component selection, tolerances, the lamp used and other factors. In any case, this running voltage will remain relatively consistent as long as the lamp is connected. If the lamp is pulled out and removed, however, this current would be terminated, and the voltage generated through the internal diode discussed above would disappear as well. If the Schmitt trigger voltage would then drop to zero in a predetermined amount of time, the system will shut down. This aspect of the system provides a safety feature during relamping. That is, when the lamp is installed, it will not become operational until the power is turned off and then turned back on again.

Given that the lamp current is already being detected according to this invention, circuits are added to sense arcing and perform desirable functions if arcing is present. Such arcing is a problem, particularly with single-pin lamps, since when the pins are pushed in, they might not seat properly because they are spring-loaded. On certain interconnections in the system, a high voltage is connected to the operational current source, such that if a gap does exist it may produce enough voltage to jump the gap and cause problems. In typical systems, which operate at 1000 volts on start up, with current on the order of 200 milliamps, thereabouts, representing a great deal of power which can generate heat and even a fire.

Thus, according to the invention, the circuit senses arcing and, conveniently, uses the transformer T2 for that purpose. In particular, the system looks for a characteristic which is produced when arcing occurs across a gap that is larger than one typically encountered when a lamp is operating properly. When the lamp is operating properly, not that much voltage is required to maintain, so that lower voltages are generally acceptable, with a higher voltage being indicative of a problem.

In the preferred embodiment, high-frequency noise and filter function is provided by C6 to perform this differentiation. C6 is connected to diodes D11 and D12, which form a detector, which converts noise to a DC voltage presented to the gate of the MOSFET Q6. Very little charge is required on the gate of the MOSFET to turn the "diode" function into a transistor, which now switches on to conduct in the opposite direction. This conduction overcomes the conduction of the device operating as a diode, and the net voltage across the device either becomes zero or some negative value which causes discharge of C9 through R10 and D14 to occur even more rapidly, thereby reacting relatively quickly to an arcing condition. Although there is a slight delay at the onset of arcing, too fast a trigger might be indicative of a relatively high-integrity connection, so shut-downs are minimized.

D16 is a clamp on the gate of the MOSFET so that it does not receive a damagingly high voltage. R13 trickles off the gate to allow for reset. When the point X is raised, the Schmitt trigger turns on rapidly, turning off Q3, but the system continues to operate. R17 works in cooperation with C6 as a differentiator to make sure that only rapidly changing noise is detected, again, preventing false shut downs from occurring.

Figure 3A:
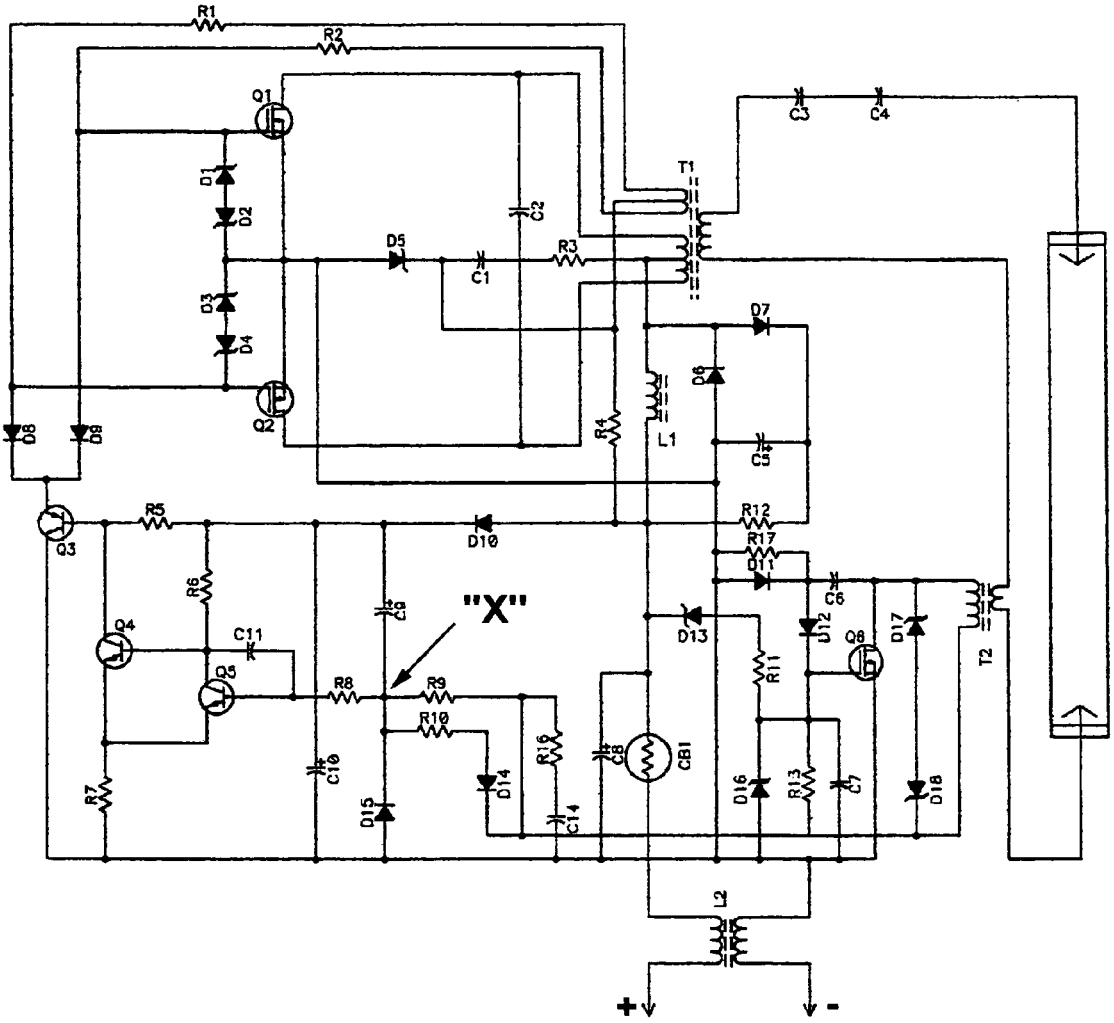
FIG. 3A is a detailed schematic diagram of the preferred embodiment.
Figure 3B:
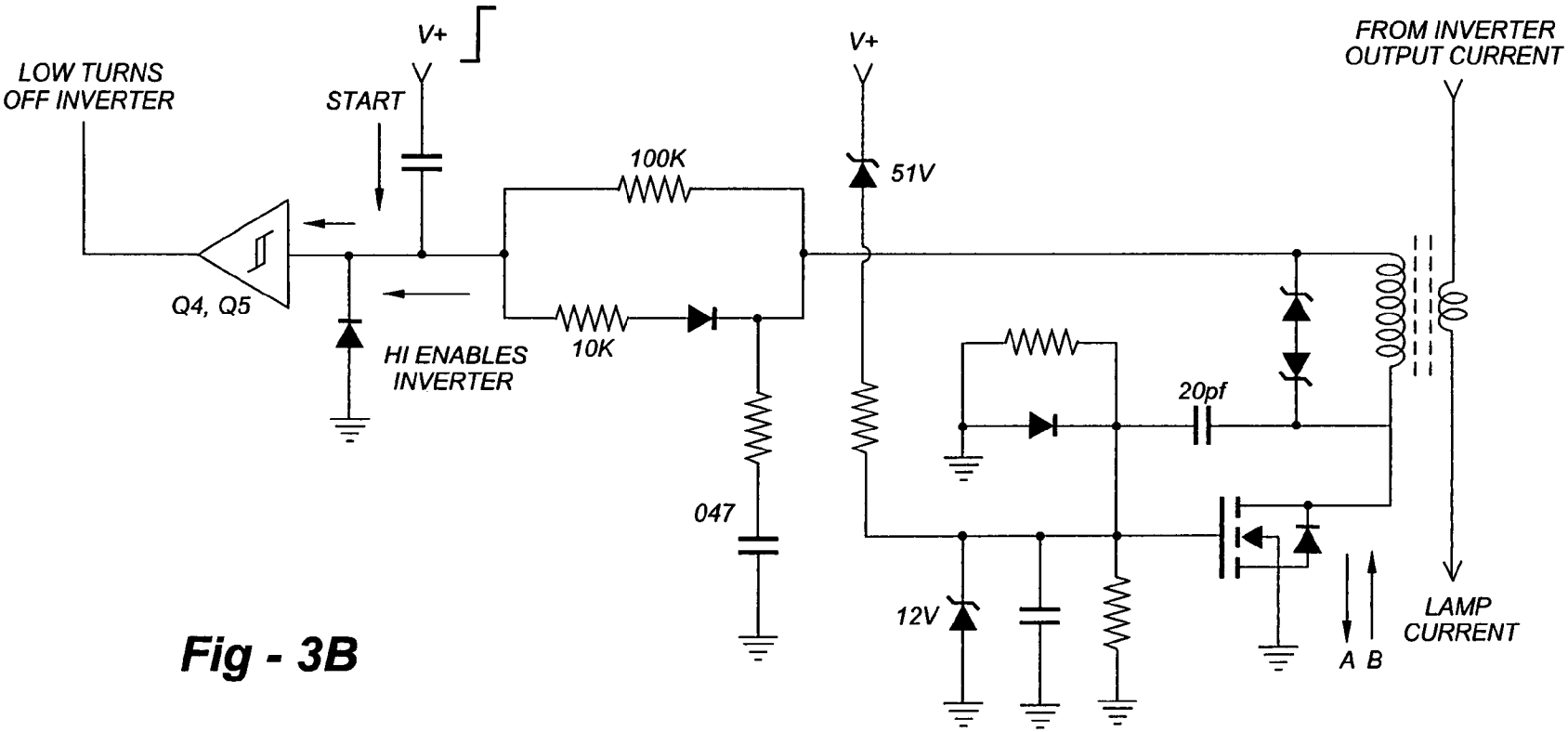
FIG. 3B is a redraw of the detailed schematic diagram to assist with understanding the way in which the circuits function.

FIG. 3B is a redrawing of the more complete schematic diagram of FIG. 3A, with component illustration perhaps better suited to understanding the operation of the various functions. Note the arrows labeled A and B flow in the direction of A through the secondary of transformer T2 through Q6 functions as a parasitic diode to generate DC voltage to keep the inverter running. T2 current B through Q6, when the device is turned on, removes the DC voltage from the base of Q5 and thus shuts down the inverter. The device of C6, R17, D11 and D12 differentiate and detect high slew-rate currents coupled through T2 during arcing condition to turn on Q6.

Figure 4:
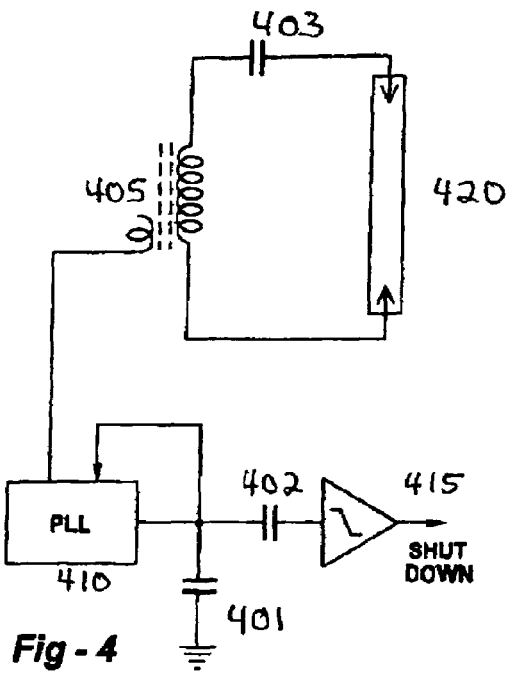
FIG. 4 is an alternative sensing circuit incorporating a phase-locked loop.

As mentioned above, alternative techniques may be used to monitor the lamp current path in accordance with this invention. FIGS. 4-7 illustrate some of these alternative techniques. In FIG. 4, a transformer 405 is still used as a sensing element, but this change in frequency changes the frequency of a phased-lock loop 410. A Royer-type oscillator is still used, but because the output is a series inductor circuit determinative of frequency, if there was a change in load condition such as arcing, this changes the frequency which can be detected by a phase-lock loop, with a Schmitt trigger 415 preferably being used once again to activate the shut down circuit.

Figure 5:
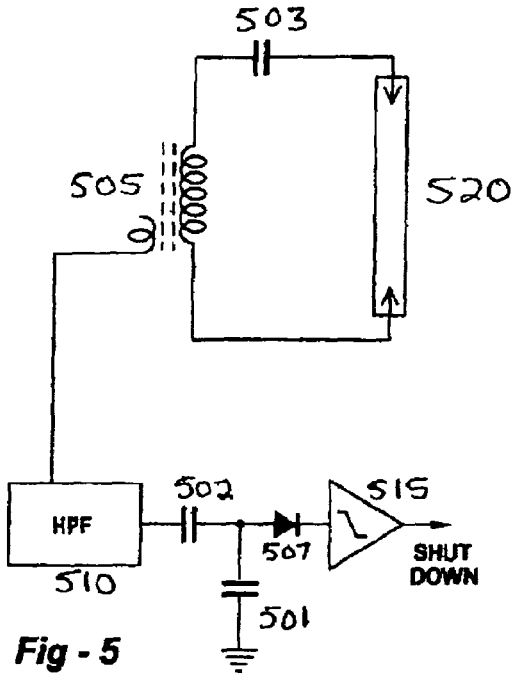
FIG. 5 is a different alternative sensing circuit involving a highpass filter and Schmitt trigger.

In FIG. 5, a transformer 505 is once again used, but a highpass filter (HPF) 510 is used in conjunction with an inverter which is less sensitive than the circuit of FIG. 4. In general, the circuit of FIG. 5 generates higher DC voltage to the Schmitt trigger 515 to bring about shut down.

Figure 6:
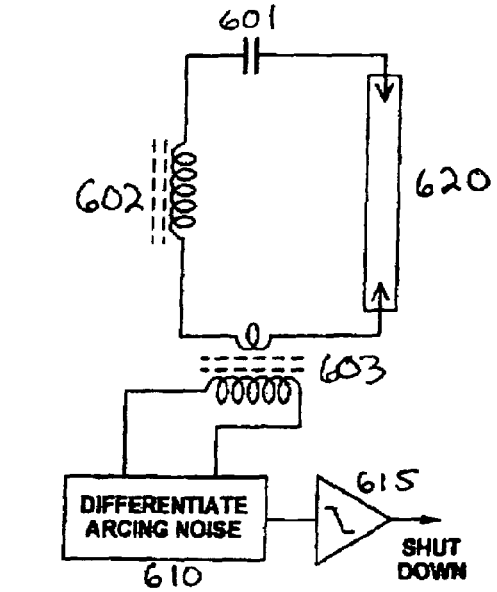
FIG. 6 is yet a further alternative sensing circuit incorporating a module to differentiate arcing noise.
Figure 7:
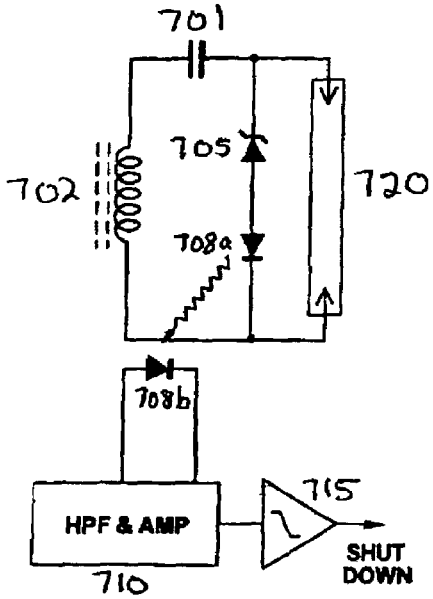
FIG. 7 is yet a different alternative sensing circuit involving an opto-isolator and highpass filter.

The circuit of FIG. 6 uses a separate isolation transformer 603 that detects a higher change in current with respect to time in conjunction with a differentiator circuit 610, the output of which is indicative of arcing. Broadly, the circuit is response to a noise component above a certain level of threshold such that if such noise is detected, it is concluded to be arcing. The circuit of FIG. 7 represents yet a further alternative embodiment utilizing an optical isolator 708*a*-708*b* to detect and increase in voltage. Under normal operating conditions, the lamp 720 would otherwise clamp the lamp voltage, but if there is an arcing condition, this will allow the voltage to rise much higher. A Zener diode 705 is used the breakdown voltage of which causes the optoisolator to activate, which, in turn, generates the shut-off signal.

Figure 8:
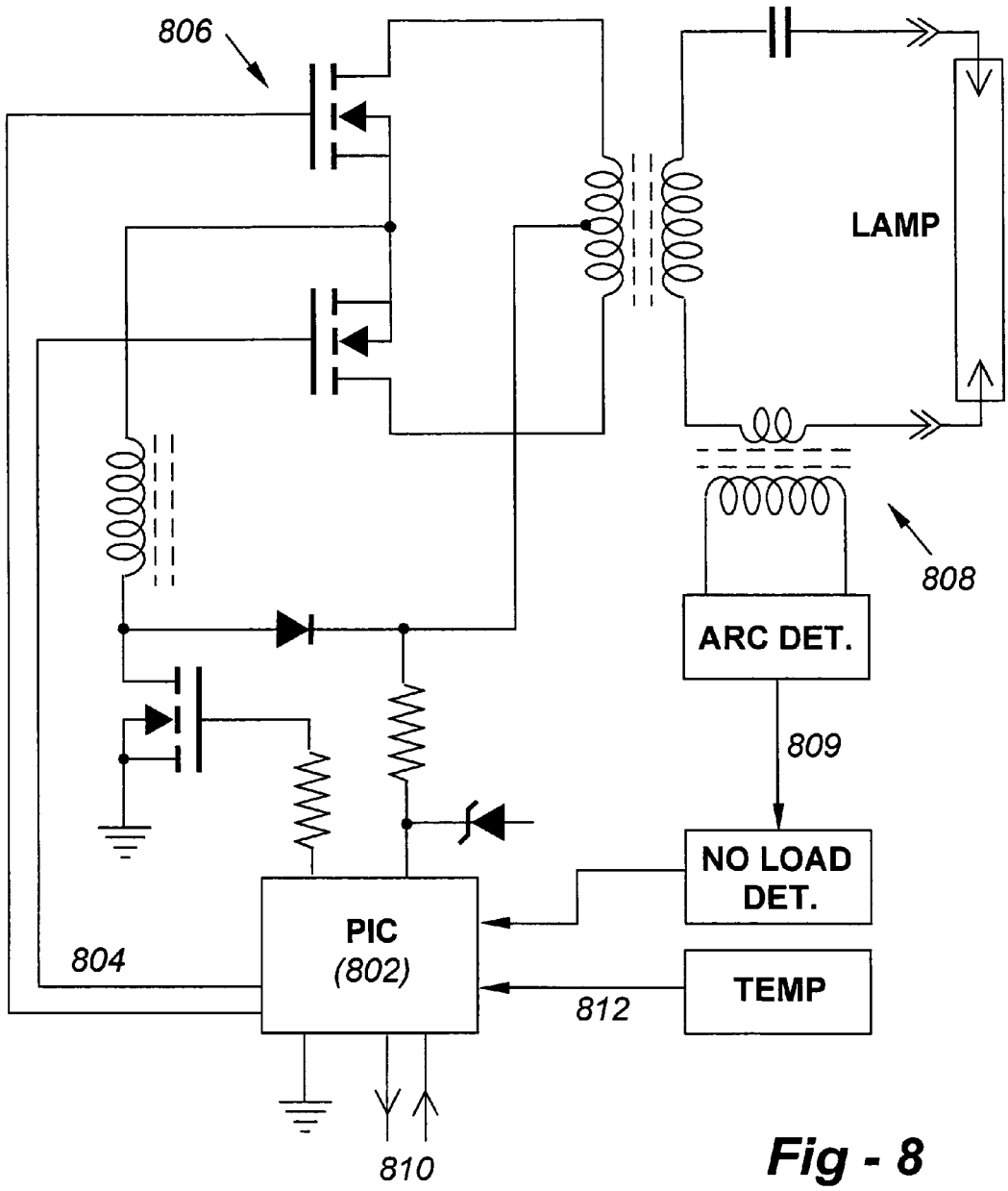
FIG. 8 represents a microprocessor-based instrumentation of the invention, enabling control and sensing to be communicated over a buss.

FIG. 8 is a drawing which shows an alternative embodiment of the invention, controlled by microprocessor 802, enabling inputs and outputs to be conducted over a bi-directional buss 810. The CPU 802, not only generates the control signals over lines 804 for the MOSFETs 806, but also inputs information regarding arc detection through sensor 808 and input 809. Use of a microprocessor also facilitates other inputs and outputs, including, for example, a temperature input at 812. Since the processor 802 generates control signals for the MOSFETs 806, it will be appreciated by one of skill in the art of electrical engineering that other functions may be controlled, including a dimming operation.

Note that although the invention has been described in terms of arc detection with respect to fluorescent tubes, the invention and embodiments described herein are not limited to fluorescent tubes, but may be used with higher-voltage systems such as neon signs, and the like, so long as it would be advantageous to sense lamp removal and/or high-frequency noise of the type generated by arcing.

I claim:

1. A shut-down circuit configured for use with an electronic ballast coupled to a lamp in a control path, the circuit comprising:

a device for sensing electrical energy associated with the control path;

an electrical circuit for shutting down the ballast in the event that the sensed energy contains high-frequency noise indicative of arcing, including arcing caused by lamp installation or removal; and electronic componentry to disable the electrical circuit for shutting down the ballast, during initial energization of the lamp, with a time constant independent of the circuit for shutting down.

2. The circuit of claim 1, wherein the device for sensing the electrical energy associated with the control path is an optical isolator.

* * * * *